US009418584B2

(12) United States Patent
Lee et al.

(10) Patent No.: US 9,418,584 B2
(45) Date of Patent: Aug. 16, 2016

(54) DISPLAY DEVICE

(71) Applicant: Samsung Display Co. Ltd., Yongin, Gyeonggi-Do (KR)

(72) Inventors: Eun Ho Lee, Suwon-si (KR); Su Hyeong Park, Gyeongju-si (KR); Jung Taek Kim, Seoul (KR); Cheol Woo Park, Suwon-si (KR); Ji Woong Jeong, Yongin-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 227 days.

(21) Appl. No.: 14/204,785

(22) Filed: Mar. 11, 2014

(65) Prior Publication Data

US 2015/0070343 A1 Mar. 12, 2015

(30) Foreign Application Priority Data

Sep. 12, 2013 (KR) ..... 10-2013-0109851

(51) Int. Cl.
*G09G 5/00* (2006.01)
*G09G 3/20* (2006.01)

(52) U.S. Cl.
CPC ..... *G09G 3/20* (2013.01); *G09G 2310/0213* (2013.01)

(58) Field of Classification Search
CPC ..... G09G 2330/021; G09G 3/3696; G09G 3/3233; G09G 2330/02; G09G 2300/0842
See application file for complete search history.

(56) References Cited

U.S. PATENT DOCUMENTS

2007/0085798 A1* 4/2007 Hashimoto ..... G09G 3/3648 345/93
2012/0120044 A1* 5/2012 Mizunaga ..... G09G 3/3614 345/211

FOREIGN PATENT DOCUMENTS

KR 1020020059476 A 7/2002
KR 1020050082337 A 8/2005
KR 1020080095356 A 10/2008
KR 1020100056228 A 5/2010
KR 1020130005807 A 1/2013

* cited by examiner

*Primary Examiner* — Lixi C Simpson
*Assistant Examiner* — Ngan T Pham Lu
(74) *Attorney, Agent, or Firm* — Cantor Colburn LLP

(57) ABSTRACT

A display device includes a display panel including a plurality of scan lines, a plurality of data lines which crosses the plurality of scan lines, and a plurality of pixels that is connected to the plurality of scan lines and the plurality of data lines, a scan driving unit which provides a plurality of scan signals, each of which includes a scan-on signal and a scan-off signal, to the plurality of scan lines, a data driving unit that provides data voltages to the plurality of data lines, and a timing control unit that determines an order in which the scan signals are provided to the plurality of scan lines, where the scan-on signal is provided to each of the plurality of scan lines based on an order of averages of the data voltages transferred to the pixels connected thereto.

19 Claims, 15 Drawing Sheets

| AD1 | AD2 | AD3 | AD4 | AD5 |
|---|---|---|---|---|
| 4.3 | 3.1 | 1.0 | 5.5 | 0.8 |

| AD1 | AD2 | AD3 | AD4 | AD5 |
|---|---|---|---|---|
| 4.3 | 3.1 | 1.0 | 5.5 | 0.8 |

| G1 | | | G2 | | |
|---|---|---|---|---|---|
| AD1 | AD2 | AD3 | AD4 | AD5 | AD6 |
| 2.0 | 4.3 | 5.5 | 4.2 | 1.5 | 5.2 |

| Gq-1 | | | Gq | | | Gq+1 | | |
|---|---|---|---|---|---|---|---|---|
| ADx | ADx+1 | ADx+2 | ADx+3 | ADx+4 | ADx+5 | ADx+6 | ADx+7 | ADx+8 |
| 1.4 | 3.4 | 2.6 | 5.1 | 4.2 | 0.7 | 0.6 | 4.8 | 1.9 |

| Gq-1 | | | Gq | | | Gq+1 | | |
|---|---|---|---|---|---|---|---|---|
| ADx | ADx+1 | ADx+2 | ADx+3 | ADx+4 | ADx+5 | ADx+6 | ADx+7 | ADx+8 |
| 1.4 | 3.4 | 2.6 | 5.1 | 4.2 | 0.7 | 0.6 | 4.8 | 1.9 |

| Gq-1 | | | Gq | | | Gq+1 | | |
|---|---|---|---|---|---|---|---|---|
| ADx | ADx+1 | ADx+2 | ADx+3 | ADx+4 | ADx+5 | ADx+6 | ADx+7 | ADx+8 |
| 1.4 | 3.4 | 2.6 | 5.1 | 4.2 | 0.7 | 0.6 | 4.8 | 1.9 |

DISPLAY DEVICE

This application claims priority to Korean Patent Application No. 10-2013-0109851, filed on Sep. 12, 2013, and all the benefits accruing therefrom under 35 U.S.C. §119, the content of which in its entirety is herein incorporated by reference.

BACKGROUND

1. Field

Exemplary embodiments of the invention relate to a display device.

2. Description of the Prior Art

A display device may include a display panel for displaying an image and a driving device for driving the display panel. Such a display device may include one of various types of display panels, such as a liquid crystal display panel, an organic light emitting display panel, a plasma display panel, and an electrophoretic display panel, and the type of a display device may be determined based on the type of the display panel thereof. The display panel may include a plurality of pixels, a plurality of scan lines and a plurality of data lines. The driving device may apply scan signals to the plurality of scan lines and may apply data signals to the plurality of data lines. Each of the plurality of pixels may be connected to one of the plurality of scan lines and one of the plurality of data lines to receive the scan signal and the data signal. The scan signal may include a signal corresponding to a scan-on period and a signal corresponding to a scan-off period, and the plurality of pixels may receive the data signals that are applied to the connected data lines only when the received scan signal corresponds to the scan-on period, while the plurality of pixels may not receive the data signals when the received scan signal corresponds to the scan-off period. The plurality of pixels may display gradations corresponding to the received data signals.

SUMMARY

As the changed amount of the voltage level of the data signal becomes greater, power consumption of the display device may become higher. For example, if an image of a stripe shape, in which low gradations and high gradations are continuously repeated in a direction where the data line extends, is displayed on the display panel, the voltage level of the data signal repeatedly swings between a low voltage and a high voltage. In this case, the power consumption of the display device may be greatly increased.

Accordingly, exemplary embodiments of the invention provide a display device with reduced power consumption.

Additional features of the invention will be set forth in part in the description which follows and in part will become apparent to those having ordinary skill in the art upon examination of the following or may be learned from practice of the invention.

According to an exemplary embodiment of the invention, a display device includes a display panel including a plurality of scan lines, a plurality of data lines which crosses the plurality of scan lines, and a plurality of pixels which is connected to the plurality of scan lines and the plurality of data lines, a scan driving unit which provides a plurality of scan signals, each of which includes a scan-on signal and a scan-off signal, to the plurality of scan lines, a data driving unit which provides data voltages to the plurality of data lines, and a timing control unit which determines an order in which the scan signals are provided to the plurality of scan lines, where the scan-on signal is provided to each of the plurality of scan lines in an order of averages of the data voltages transferred to the pixels connected thereto.

According to another exemplary embodiment of the invention, a display device includes a display panel including a plurality of scan lines which is divided into a plurality of groups, a plurality of data lines which crosses the plurality of scan lines, and a plurality of pixels connected to the plurality of scan lines and the plurality of data lines, a scan driving unit which provides a plurality of scan signals, each of which includes a scan-on signal and a scan-off signal, to the plurality of scan lines, a data driving unit which provides a plurality of data voltages to the plurality of data lines, and a timing control unit which determines an order in which the plurality of scan signals are provided to the plurality of scan lines, where the scan driving unit sequentially provides the plurality of scan signals to the plurality of groups, and the scan-on signal is provided to each of the scan lines of the plurality of groups based on an order of averages of the data voltages to be transferred to the pixels connected thereto.

According to another exemplary embodiment of the invention, there is provided a display device comprising a display panel including a plurality of scan lines which is divided into a plurality of groups, a plurality of data lines which crosses the plurality of scan lines, and a plurality of pixels connected to the plurality of scan lines and the plurality of data lines, a scan driving unit which provides a plurality of scan signals, each of which includes a scan-on signal and a scan-off signal, to the plurality of scan lines, a data driving unit which provides data voltages to the plurality of data lines, and a timing control unit which determines an order in which the plurality of scan signals is provided to the plurality of scan lines, where the scan driving unit provides the plurality of scan signals sequentially to the plurality of groups, and the scan-on signal is provided to each of the scan lines in each of the plurality of groups based on an order of averages of the data voltages to be transferred to the pixels connected thereto, where the order of the averages of the data voltage is an ascending order or a descending order.

According to exemplary embodiments of the invention, the power consumption of the display device can be reduced through reduction of the change amount of the data voltage.

BRIEF DESCRIPTION OF THE DRAWINGS

The above and other features of the invention will be more apparent from the following detailed description taken in conjunction with the accompanying drawings, in which.

DETAILED DESCRIPTION

Figure 1:
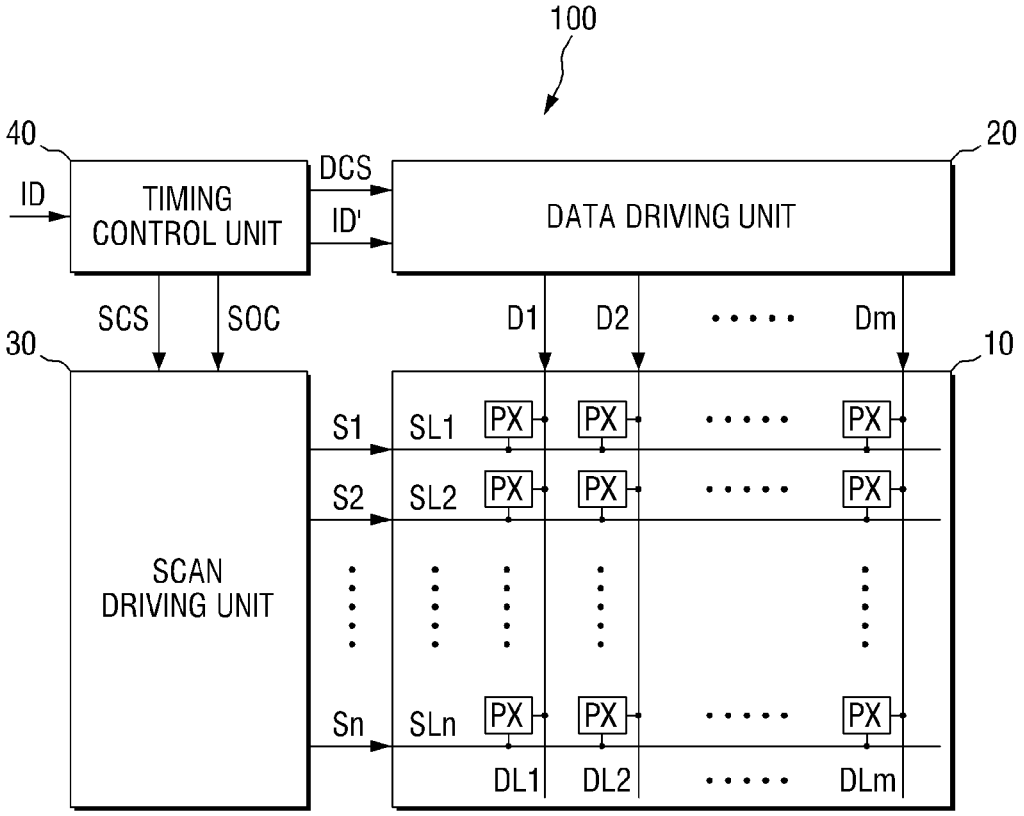
FIG. 1 is a block diagram illustrating an exemplary embodiment of a display device, according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on," or "connected to" another element or layer, it can be directly on or connected to the other element or layer or intervening elements or layers may be present. In contrast, when an element is referred to as being "directly on" or "directly connected to" another element or layer, there are no intervening elements or layers present.

Spatially relative terms, such as "below," "beneath," "lower," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments of the invention are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, exemplary embodiments of the invention will be described in detail with reference to the accompanying drawings.

FIG. 1 is a block diagram illustrating an exemplary embodiment of a display device, according to the invention. Referring to FIG. 1, an exemplary embodiment of a display device 100 includes a display panel 10, a scan driving unit 30, a data driving unit 20 and a timing control unit 40.

The display panel 10 may be one of various types of display panel, which are classified based on a method for displaying an image. In such an embodiment, the display panel 10 may be one of a liquid crystal display panel, an organic light emitting display panel, a plasma display panel and an electrophorectic display panel, for example, but is not limited thereto. The display panel 10 includes a plurality of scan lines SL1 to SLn, a plurality of data lines DL1 to DLm, and a plurality of pixels PX. The plurality of scan lines SL1 to SLn may extend substantially in a first direction, and may be substantially parallel to each other. The plurality of scan lines SL1 to SLn may include first to n-th scan lines SL1 to SLn which are arranged in order. A plurality of scan signals S1 to Sn may be applied to the plurality of scan lines SL1 to SLn. The plurality of data lines DL1 to DLm may include first to m-th data lines DL1 to DLm. The plurality of data lines DL1 to DLm may cross the plurality of scan lines SL1 to SLn. The plurality of data lines DL1 to DLm may extend in a second direction that is different from the first direction of the plurality of scan lines SL1 to SLn, and may be substantially parallel to each other. A plurality of data voltages D1 to Dm may be applied to the plurality of data lines DL1 to DLm. The plurality of pixels PX may be arranged substantially in a matrix form, but is not limited thereto. Each of the plurality of pixels PX may be connected to a corresponding scan line of the plurality of scan lines SL1 to SLn and a corresponding data line of the plurality of data lines DL1 to DLm. The plurality of pixels PX may receive the plurality of data voltages D1 to Dm which are applied to the connected data lines DL1 to DLm in response to the scan signals S1 to Sn provided from the connected scan lines SL1 to SLn. Each of the plurality of scan signals S1 to Sn may include a scan-on signal Son and a scan-off signal Soff (shown in FIG. 2). In such an embodiment, the plurality of pixels PX may receive the data voltages D1 to Dm that are applied to the connected data lines DL1 to DLm when the plurality of pixels PX receives the scan-on signals Son, while the plurality of pixels PX may not receive the data voltages D1 to Dm when the plurality of pixels PX receives the scan-off signals Soff. The plurality of pixels PX may display gradations that correspond to the received data voltages D1 to Dm.

The scan driving unit 30 may generate and provide the plurality of scan signals S1 to Sn to the plurality of scan lines SL1 to SLn. The plurality of scan signals S1 to Sn may include first to n-th scan signals S1 to Sn. The first to n-th scan signals S1 to Sn may be provided to the first to n-th scan lines SL1 to SLn in a predetermined order. In such an embodiment, a scan order or a timing of application of each of the first to n-th scan signals S1 to Sn to the first to n-th scan lines SL1 to SLn may be determined based on an average of corresponding data voltages, that is, the data voltages to be applied to the pixels in response thereto. In an exemplary embodiment, the scan driving unit 30 may generate the plurality of scan signals S1 to Sn such that the scan-on signals Son are applied to the plurality of scan lines SL1 to SLn based on the order of averages of the data voltages D1 to Dm to be transferred to the pixels PX connected to the plurality of scan lines SL1 to SLn. Herein, an average of data voltages means an average of data voltages to be applied to pixels connected to a same scan line in response to a same scan signal applied to the same scan line in a frame. In such an embodiment, where the scan-on signals Son are applied to the plurality of scan lines SL1 to SLn in the order of averages of the data voltages D1 to Dm to be transferred to the pixels PX connected to the plurality of scan lines SL1 to SLn, the variation of the data voltage D1 to Dm may be reduced, and thus the power consumption of the display device 100 may be reduced. This will be described in greater detail with reference to FIGS. 2 and 3.

Figure 2:
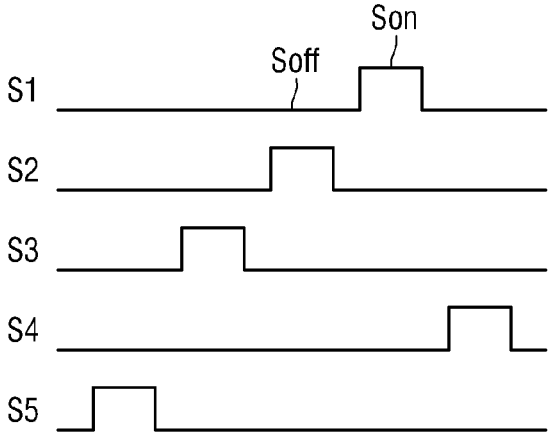
FIGS. 2 and 3 are diagrams illustrating scan signals that correspond to average data voltages of exemplary embodiments of a display device, according to the invention.
Figure 3:
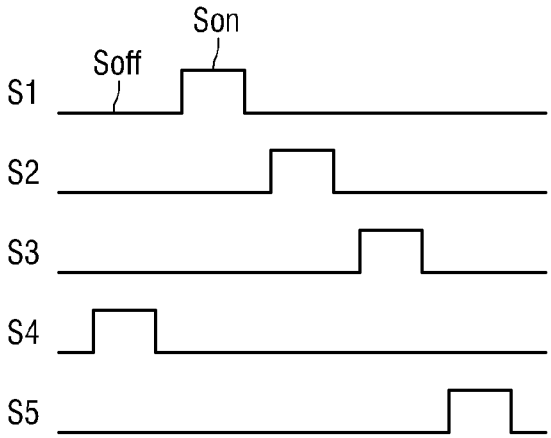

Referring to FIGS. 2 and 3 are diagrams illustrating scan signals that correspond to average data voltages of exemplary embodiments of a display device, according to the invention. Referring to FIG. 2, first to fifth average data voltages AD1 to AD5 are averages of the data voltages D1 to Dm to be transferred to the pixels PX connected to the first to fifth scan lines SL1 to SL5, respectively. The unit of the first to fifth average data voltages AD1 to AD5 of FIG. 2 is volt (V), and values of the first to fifth average data voltages AD1 to AD5 are merely exemplary values for convenience in explanation. FIG. 2 illustrates an exemplary embodiment where the number of scan lines is five, for convenience of description, but the invention is not limited thereto. In an alternative exemplary embodiment, the number of scan lines may be variously modified. The first to fifth scan signals S1 to S5 may be applied to the first to fifth scan lines SL1 to SL5 in order. Each of the first to fifth scan signals S1 to S5 may include a scan-on signal Son and a scan-off signal Soff. In a frame, the scan-on signals Son may be applied to the first to fifth scan lines SL1 to SL5 in the reverse order of the average data voltage corresponding thereto. Since the fifth average data voltage AD5, which is an average of the data voltages D1 to Dm to be transferred to the pixels PX connected to the fifth scan line SL5, has the lowest value among the first to fifth average data voltages AD1 to AD5, the scan-on signals Son may be applied to the fifth scan line SL5 before other scan lines. Thereafter, in the reverse order of average data voltage corresponding thereto, the scan-on signals Son may be applied to the first to fourth scan lines SL1 to SL4 in an ascending order. If the scan-on signals Son are applied to the plurality of scan lines SL1 to SLn in the reverse order of average data voltage corresponding thereto, that the number of a voltage swing in the data voltages D1 to Dm may be reduced, and thus the power consumption of the display device 100 may be reduced.

FIG. 3 illustrates an alternative exemplary embodiment, which is different from the exemplary embodiment shown in FIG. 2. Referring to FIG. 3, the scan-on signals Son may be applied to the first to fifth scan lines SL1 to SL5 in the order of the average data voltage corresponding thereto. Since the fourth average data voltage AD4, which is an average of the data voltages D1 to Dm to be transferred to the pixels PX connected to the fourth scan line SL4, has the highest value among the first to fifth average data voltages AD1 to AD5, the scan-on signals Son may be applied to the fourth scan line SL4 before the other scan lines. Thereafter, in the order of the average data voltage corresponding thereto, the scan-on signals Son may be applied to the first to third scan lines SL1 to SL3 and the fifth scan line SL5 in a descending order. In such an embodiment, where the scan-on signals Son are applied to the plurality of scan lines SL1 to SLn in the order of the average data voltage corresponding thereto, the number of the voltage swing in the data voltages D1 to Dm may be reduced, and thus the power consumption of the display device 100 may be reduced.

Referring back to FIG. 1, the data driving unit 20 may generate and apply the plurality of data voltages D1 to Dm to the plurality of data lines DL1 to DLm. The data driving unit 20 may receive corrected image data ID' from the timing control unit 40, and may generate the voltages D1 to Dm based on the corrected image data ID'. The corrected image data ID' may be data obtained by rearranging information that is included in image data ID corresponding to the order in which the scan-on signals Son are applied to the plurality of scan lines SL1 to SLn.

The timing control unit 40 may receive the image data ID, and may generate a scan driving unit control signal SCS, a scan order control signal SOC, a data driving unit control signal DCS, and the corrected image data ID' based on the image data ID. The scan driving unit control signal SCS may be provided to the scan driving unit 30 to control the scan driving unit 30, and may include a vertical sync signal. The scan order control signal SOC may include information on the order in which the scan-on signals Son are applied to the plurality of scan lines SL1 to SLn, and may be provided to the scan driving unit 30. The scan driving unit 30 may generate the plurality of scan signals S1 to Sn based on the scan order control signal SOC such that the scan-on signals Son are provided to the plurality of scan lines SL1 to SLn in the order that corresponds to the scan order control signal SOC. The data driving unit control signal DCS may be provided to the data driving unit 20 to control the data driving unit 20, and may include a horizontal sync signal. The corrected image data ID' may be data obtained by rearranging information that is included in the image data ID corresponding to the order in which the scan-on signals Son are applied to the plurality of scan lines SL1 to SLn.

Figure 4:
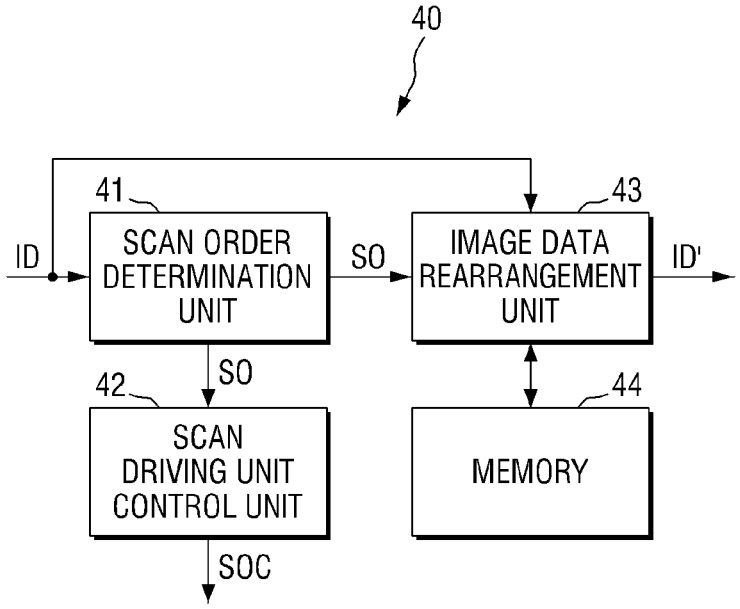
FIG. 4 is a block diagram illustrating an exemplary embodiment of a timing control unit in FIG. 1.

Hereinafter, referring to FIG. 4, the timing control unit will be described in detail. FIG. 4 is a block diagram of an exemplary embodiment of a timing control unit in FIG. 1. Referring to FIG. 4, the timing control unit 40 may include a scan order determination unit 41, a scan driving unit control unit 42, an image data rearrangement unit 43 and a memory 44.

In such an embodiment, the scan order determination unit 41 may receive the image data ID, obtain an average of the data voltages D1 to Dm to be transferred to the pixels PX connected to a scan line of the plurality of scan lines SL1 to SLn, from the image data ID, and determine the order of application of the scan-on signals Son to the plurality of scan lines SL1 to SLn in the order of the averages of the data voltage corresponding thereto. In an exemplary embodiment, the order of application of the scan-on signals Son to the plurality of scan lines SL1 to SLn may be the reverse order of the averages of the data voltages D1 to Dm corresponding thereto, as shown in FIG. 2. In an alternative exemplary embodiment, the order of application of the scan-on signals Son to the plurality of scan lines SL1 to SLn may be the order of the averages of the data voltages D1 to Dm corresponding thereto, as shown in FIG. 3. The scan order determination unit 41 may generate a scan order signal SO that indicates the order of application of the scan-on signals Son to the plurality of scan lines SL1 to SLn.

The scan driving unit control unit 42*a* may receive the scan order signal SO and may generate the scan order control signal SOC for controlling the scan driving unit 30 based on the scan order signal SO.

The image data rearrangement unit 43 may receive the scan order signal SO and may generate the corrected image data ID' through rearrangement of the information included in the image data ID based on the scan order signal SO. The image data rearrangement unit 43 may generate the corrected image data ID' through rearrangement of the information on the gradations that are displayed on the plurality of pixels PX included in the image data ID in the order of application of the scan-on signals Son to the plurality of scan lines SL1 to SLn by rows of the plurality of pixels PX.

In the memory 44, gradation data of the plurality of pixels PX included in the image data ID may be sequentially stored in the order that the scan-on signals Son are applied to the plurality of scan lines SL1 to SLn by rows of the plurality of pixels PX. The image data rearrangement unit 43 may sequentially store the gradation data of the plurality of pixels PX included in the image data ID in the memory 44 in the order of application of the scan-on signals Son to the plurality of scan lines SL1 to SLn by rows of the plurality of pixels PX to generate the corrected image data ID'.

Figure 5:
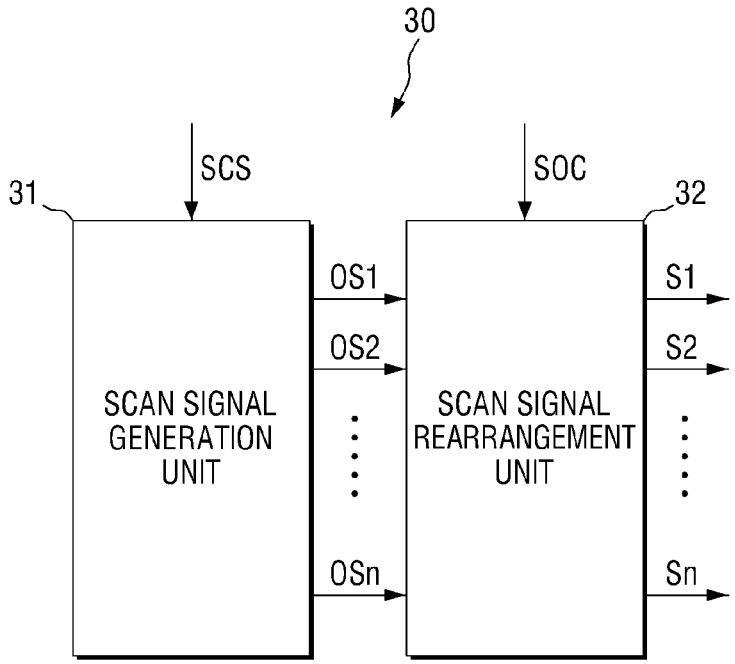
FIG. 5 is a block diagram illustrating an exemplary embodiment of a scan driving unit in FIG. 1.
Figure 6:
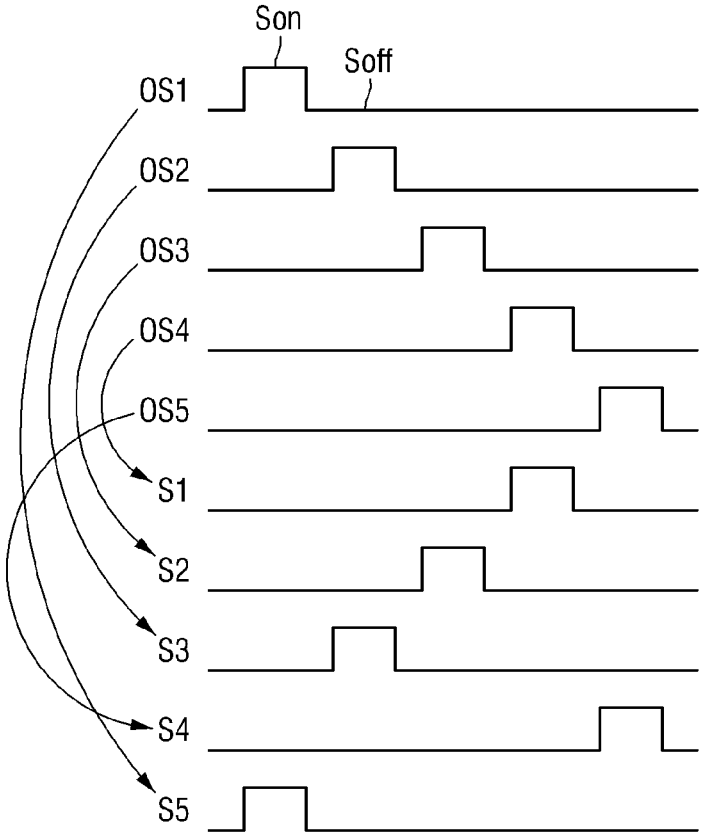
FIG. 6 is a diagram illustrating original scan signals and scan signals of an exemplary embodiment of a display device, according to the invention.

Hereinafter, referring to FIGS. 5 and 6, the scan driving unit 30 will be described in more detail. FIG. 5 is a block diagram illustrating an exemplary embodiment of a scan driving unit of FIG. 1. FIG. 6 is a diagram illustrating original scan signals and scan signals of an exemplary embodiment of a display device, according to the invention. The first to fifth scan signals S1 to S5 of FIG. 6 may be substantially the same as the first to fifth scan signals S1 to S5 of FIG. 2. Referring to FIG. 5, the scan driving unit 30 may include a scan signal generation unit 31 and a scan signal rearrangement unit 32.

The scan signal generation unit 31 may receive the scan driving unit control signal SCS and may generate a plurality of original scan signals OS1 to OSn based on the scan driving unit control signal SCS. The plurality of original scan signals OS1 to OSn may include first to n-th original scan signals OS1 to OSn. As illustrated in FIG. 6, each of the plurality of original scan signals OS1 to OSn may include a scan-on signal Son and a scan-off signal Soff. The scan-on signals Son may be sequentially arranged in the first to n-th original scan signals OS1 to OSn, and the order of arrangement of the scan-on signals Son in the first to n-th original scan signals OS1 to OSn may not be varied.

The scan signal rearrangement unit 32 may receive the plurality of original scan signals OS1 to OSn, and may generate the plurality of scan signals S1 to Sn through rearrangement of the original scan signals OS1 to OSn. The scan signal rearrangement unit 32 may receive the scan order control signal SOC, and may generate the plurality of scan signals S1 to Sn through rearrangement of the plurality of original scan signals OS1 to OSn based on the scan order control signal SOC. In an exemplary embodiment, as shown in FIG. 6, to control the order of arrangement of the scan-on signals Son in the first to fifth scan signals S1 to S5, the scan signal rearrangement unit 32 may output the first original scan signal OS1 as the fifth scan signal S5, output the second original scan signal OS2 as the third scan signal S3, output the third original scan signal OS3 as the second scan signal S2, output the fourth original scan signal OS4 as the first scan signal S1, and output the fifth original scan signal OS5 as the fourth scan signal S4. Although not illustrated, the scan signal rearrangement unit 32 may include a plurality of multiplexers, and the scan order control signal SOC may control the operation of the plurality of multiplexers.

Figure 7:
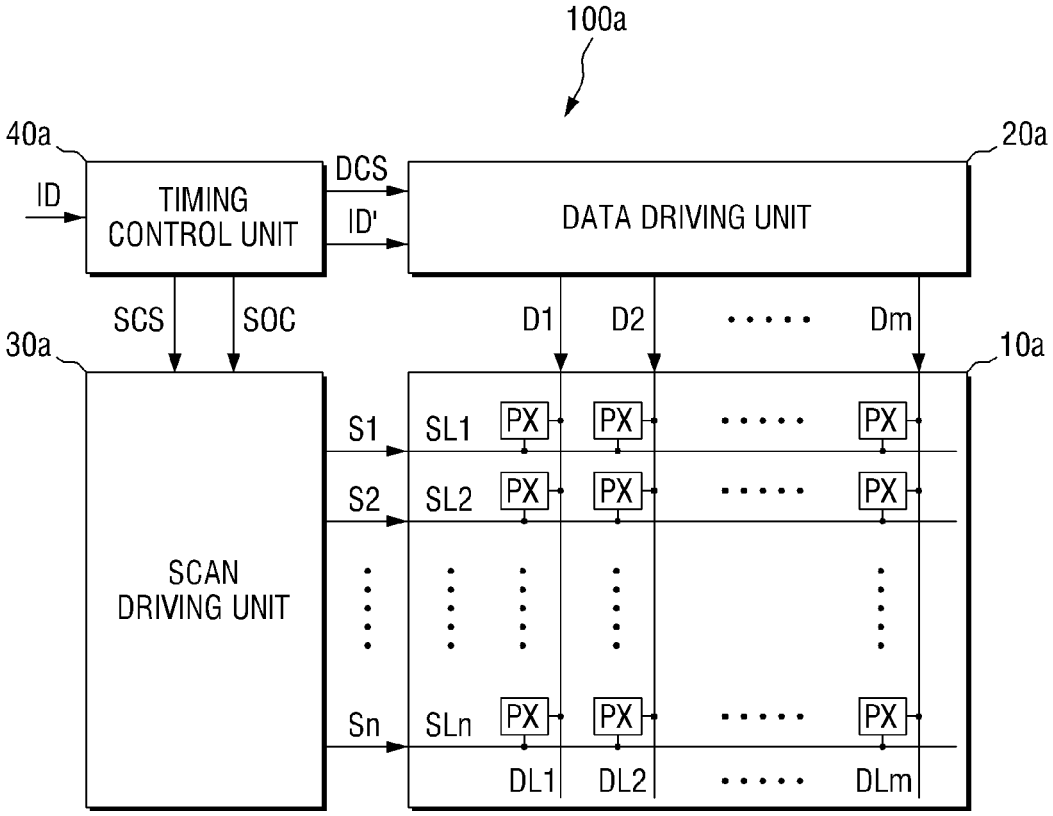
FIG. 7 is a block diagram illustrating an alternative exemplary embodiment of a display device, according to the invention.

Hereinafter, referring to FIGS. 7 to 11, another exemplary embodiment of the invention will be described. FIG. 7 is a block diagram illustrating another alternative exemplary embodiment of a display device, according to the invention. Referring to FIG. 7, a display device 100*a* includes a display panel 10*a*, a scan driving unit 30*a*, a data driving unit 20*a* and a timing control unit 40*a*.

The display panel 10*a* includes a plurality of scan lines SL1 to SLn, a plurality of data lines DL1 to DLm which cross the plurality of scan lines SL1 to SLn, and a plurality of pixels PX which are connected to the plurality of scan lines SL1 to SLn and the plurality of data lines DL1 to DLn. In such an embodiment, each of the plurality of pixels PX may be connected to a corresponding scan line of the plurality of scan lines SL1 to SLn and a corresponding data line of the plurality of data lines DL1 to DLm. The plurality of scan lines SL1 to SLn may be divided into a plurality of groups, which will now be described in detail with reference to FIG. 8.

Figure 8:
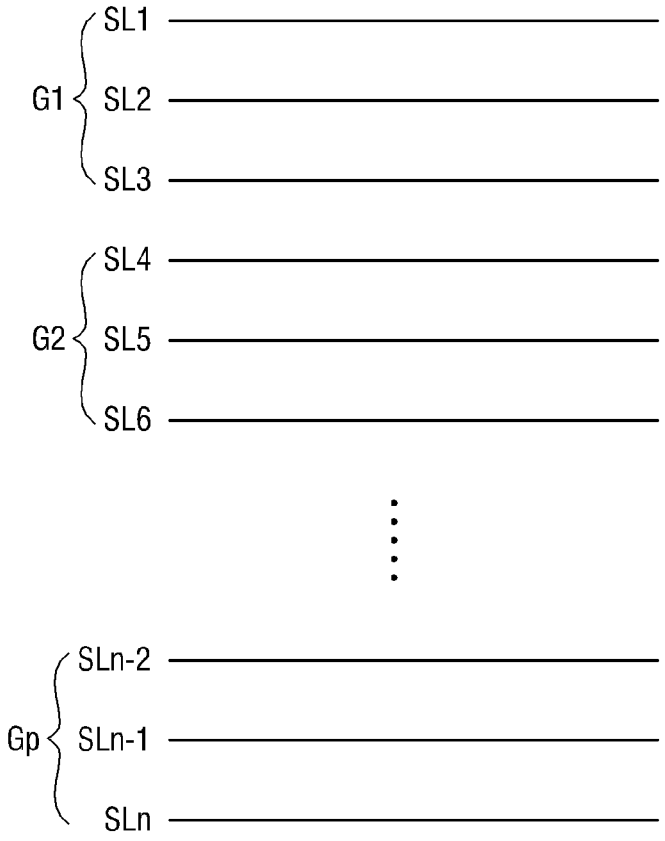
FIG. 8 is a diagram illustrating an exemplary embodiment of a plurality of scan lines in FIG. 7.

FIG. 8 is a diagram illustrating a plurality of scan lines in FIG. 7. Referring to FIG. 8, the plurality of scan lines SL1 to SLn may be divided into first to p-th groups G1 to Gp. The first to p-th groups G1 to Gp may include scan lines that are successively arranged. In an exemplary embodiment, as shown in FIG. 8, each of the first to p-th groups G1 to Gp may include three scan lines, but not being limited thereto. In an alternative exemplary embodiment, the number of scan lines that are included in each group may be variously modified. In some embodiments, the number of scan lines included in each of the first to p-th groups G1 t Gp may differ from each other. The first to p-th groups G1 to Gp may be arranged in the same order as the order of arrangement of the first to n-th scan lines SL1 to SLn.

Referring back to FIG. 7, the scan driving unit 30*a* may provide the plurality of scan signals S1 to Sn, each of which includes a scan-on signal Son and a scan-off signal Soff, to the plurality of scan lines SL1 to SLn. The scan driving unit 30*a* may provide scan signals to the plurality of scan lines SL1 to SLn such that variation of averages of data voltages D1 to Dm, which are transferred to the pixels connected to the scan lines SL1 to SLn that are included in the plurality of groups G1 to Gn, becomes minimized. Application of the scan signals to the plurality of scan lines SL1 to SLn will be described in greater detail with reference to FIG. 9.

Figure 9:
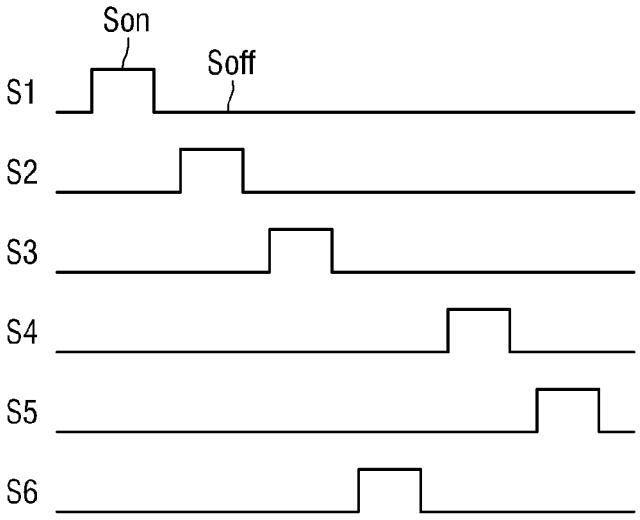
FIG. 9 is a diagram illustrating scan signals that correspond to average data voltages of an exemplary embodiment of a display device, according to the invention.

FIG. 9 is a diagram illustrating scan signals that correspond to average data voltages in an exemplary embodiment of a display device, according to the invention. Referring to FIG. 9, the scan-on signals Son may be initially applied to the first scan line SL1 in advance of other scan lines independently of values of average data voltages AD1 to AD6 in a frame. After the scan-on signals Son are applied to the first scan line SL1, the scan-on signals Son may be applied to a scan line in the first group G1 to which the average data voltage value applied to the pixels PX connected is the closest to the first average data voltage AD 1. In such an embodiment, as shown in FIG. 9, the scan-on signals Son may be applied to the second scan line SL2, to which an average data voltage value of 4.3 applied the pixels PX connected, after the scan-on signals Son are applied to the first scan line SL1. In this manner, the order of application of the scan-on signals Son in the first group may be determined. When the scan-on signals Son are applied to all the scan lines SL1 to SL3 included in the first group G1, the scan-on signals Son may be applied to the scan lines SL4 to SL6 included in the second group G2. In such an embodiment, the scan-on signals Son may be firstly applied to a scan line, the average data voltage value of the pixels PX connected to which is the closest to the value of the average data voltage lastly applied in the first group G1, among the pixel lines SL4 to SL6 included in the second group G2. In one exemplary embodiment, for example, the scan-on signals Son may be applied to the sixth scan line SL6, to which the average data voltage value that is applied to the pixels PX connected, among the pixel lines SL4 to SL6 included in the second group G2, is the closest to the value of the average data voltage AP3 of the pixels PX connected to the third scan line SL3, to which the scan-on signal Son is lastly applied in the first group G1, in advance of other scan lines in the second group G2. In the same manner as the first group G1, the order of application of the scan-on signals Son may be determined based on the average data voltage values in the second group G2. Although not illustrated, the order of application of the scan-on signals Son may be determined in the third to p-th groups G3 to Gp in the same manner as the second group G2. As described above, in an alternative exemplary embodiment of the invention, the scan-on signals Son are sequentially applied to the first to p-th groups G1 to Gp, and in the first to p-th groups G1 to Gp, the scan-on signals Son may be applied to the scan line having the average data voltage that is closest to the average data voltage of a scan line in a previous group, to which the scan-on signals Son are lastly applied in the previous group such that the variation of the average data voltage becomes substantially minimized. According to such an embodiment, the variation of the average data voltage becomes minimized in the first to p-th groups G1 to Gp, and thus the power consumption of the display device 100*a* may be reduced.

Referring again to FIG. 7, the data driving unit 20*a* may provide the data voltages D1 to Dm to the plurality of data lines DL1 to DLm. The data driving unit 20*a* may receive corrected image data ID', and may generate the corresponding data voltages D1 to Dm based on the corrected image data ID'. The corrected image data ID' may be data obtained by rearranging information that is included in image data ID corresponding to the order in which the scan-on signals Son are applied to the plurality of scan lines SL1 to SLn.

The timing control unit 40*a* may receive the image data ID, and may generate a scan driving unit control signal SCS, a scan order control signal SOC, a data driving unit control signal DCS and the corrected image data ID' based on the image data ID. Hereinafter, referring to FIG. 10, the timing control unit 40*a* may be described in greater detail.

Figure 10:
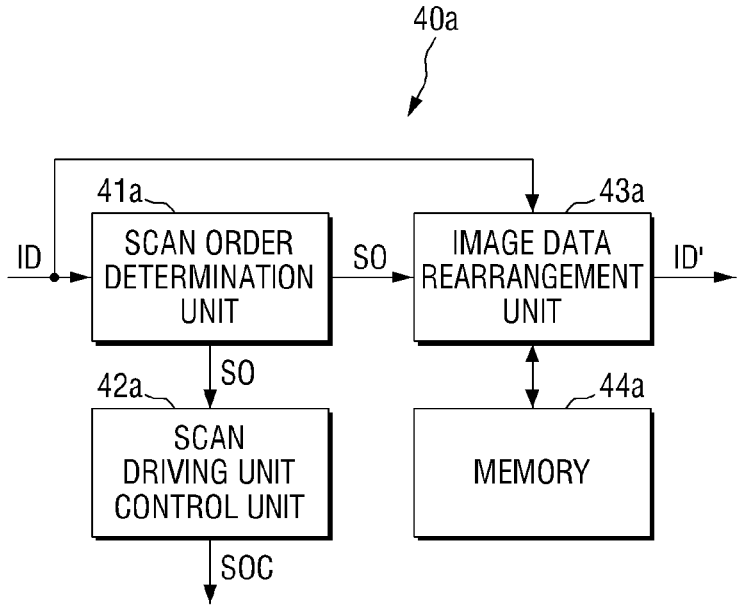
FIG. 10 is a block diagram illustrating an exemplary embodiment of a timing control unit in FIG. 7.

FIG. 10 is a block diagram illustrating an exemplary embodiment of a timing control unit in FIG. 7. Referring to FIG. 10, the timing control unit 40*a* may include a scan order determination unit 41*a*, a scan driving unit control unit 42*a*, an image data rearrangement unit 43*a* and a memory 44*a*.

The scan order determination unit 41*a* may receive the image data ID, obtain an average of data voltages D1 to Dm to be transferred to the pixels PX connected to a scan line of the plurality of scan lines SL1 to SLn, from the image data ID, and determine an order in which the scan-on signals Son are applied to the plurality of scan lines SL1 to SLn such that the variation of the average of the data voltages D1 to Dm becomes substantially minimized in the groups G1 to Gn.

The scan driving unit control unit 42*a* may receive the scan order signal SO and may generate the scan order control signal SOC for controlling the scan driving unit 30 based on the scan order signal SO.

The image data rearrangement unit 43*a* may receive the scan order signal SO and may generate the corrected image data ID' through rearrangement of the information included in the image data ID based on the scan order signal SO. The image data rearrangement unit 43*a* may generate the corrected image data ID' through rearrangement of the information on the gradations that are displayed on the plurality of pixels PX included in the image data ID in the order in which the scan-on signals Son are applied to the plurality of scan lines SL1 to SLn by rows of the plurality of pixels PX.

In such an embodiment, the memory 44*a* may sequentially stores gradation data of the plurality of pixels PX included in the image data ID based on the order in which the scan-on signals Son are applied to the plurality of scan lines SL1 to SLn by rows of the plurality of pixels PX. The image data rearrangement unit 43*a* may sequentially store the gradation data of the plurality of pixels PX included in the image data ID in the memory 44*a* based on the order in which the scan-on signals Son are applied to the plurality of scan lines SL1 to SLn by rows of the plurality of pixels PX to generate the corrected image data ID'.

Figure 11:
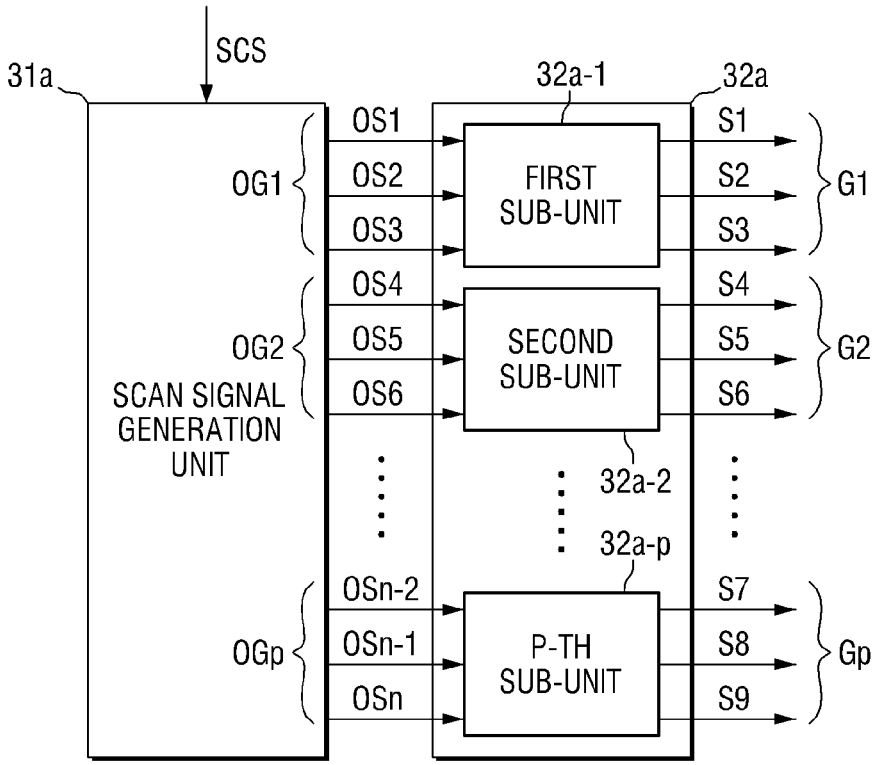
FIG. 11 is a block diagram illustrating an exemplary embodiment of a scan driving unit of FIG. 7.

Hereinafter, referring to FIG. 11, the scan driving unit 30*a* will be described in greater detail. FIG. 11 is a block diagram illustrating an exemplary embodiment of a scan driving unit of FIG. 7.

Referring to FIG. 11, the scan driving unit 30*a* may include a scan signal generation unit 31*a* and a scan signal rearrangement unit 32*a*. The scan signal generation unit 31*a* may receive the scan driving unit control signal SCS and may generate a plurality of original scan signals OS1 to OSn based on the scan driving unit control signal SCS. The plurality of original scan signals OS1 to OSn may include first to n-th original scan signals OS1 to OSn. The scan-on signals Son may be sequentially arranged in the first to n-th original scan signals OS1 to OSn, and the order in which the scan-on signals Son are arranged in the first to n-th original scan signals OS1 to OSn may be maintained. The first to n-th original scan signals OS1 to OSn may be divided into a plurality of original groups including first to p-th original groups OG1 to OGp. The first to p-th original group OG1 to OGp may correspond to the first to p-th groups G1 to Gp, respectively. If "a" is an integer that is equal to or greater than "1" and is equal to or less than "p", scan signal that are provided to the scan lines included in the a-th group Ga may be generated from the original scan signal included in the a-th original group OGa. The number of original scan signals included in the a-th original group OGa may be equal to the number of scan lines included in the a-th group Ga.

The scan signal rearrangement unit 32*a* may receive the plurality of original scan signals OS1 to OSn, and may generate the plurality of scan signals S1 to Sn through rearrangement of the original scan signals OS1 to OSn. The scan signal rearrangement unit 32*a* may receive the scan order control signal SOC, and may generate the plurality of scan signals S1 to Sn through rearrangement of the plurality of original scan signals OS1 to OSn based on the scan order control signal SOC. The scan signal rearrangement unit 32*a* may include a plurality of sub-units, e.g., first to p-th sub-units 32*a*-1 to 32*a*-*p*. The first to p-th sub-units 32*a*-1 to 32*a*-*p* may receive the original scan signals included in the first to p-th original groups OG1 to OGn, respectively, and may generate the scan signals that are applied to the scan lines include in the first to p-th groups G1 to Gp through rearrangement of the original scan signals applied thereto. The first to p-th sub-units 32*a*-1 to 32*a*-*p* may include a plurality of multiplexers. As described above, in the case of dividing the plurality of scan lines SL1 to SLn into the plurality of groups G1 to Gp and generating the scan signals to be applied to the scan lines included in the plurality of groups G1 to Gp through rearrangement of only the original scan signals included in the groups of the original scan signals OS1 to OSn corresponding to the respective groups, the configuration of the scan signal rearrangement unit 32*a* may be simpler in comparison to the case where all the original scan signals are rearranged.

Other features of the display device 100*a* shown in FIG. 7 are substantially to the same as corresponding features of the exemplary embodiment of the display device 100*a* show in FIG. 1, and any repetitive detailed description thereof will be omitted.

Figure 12:
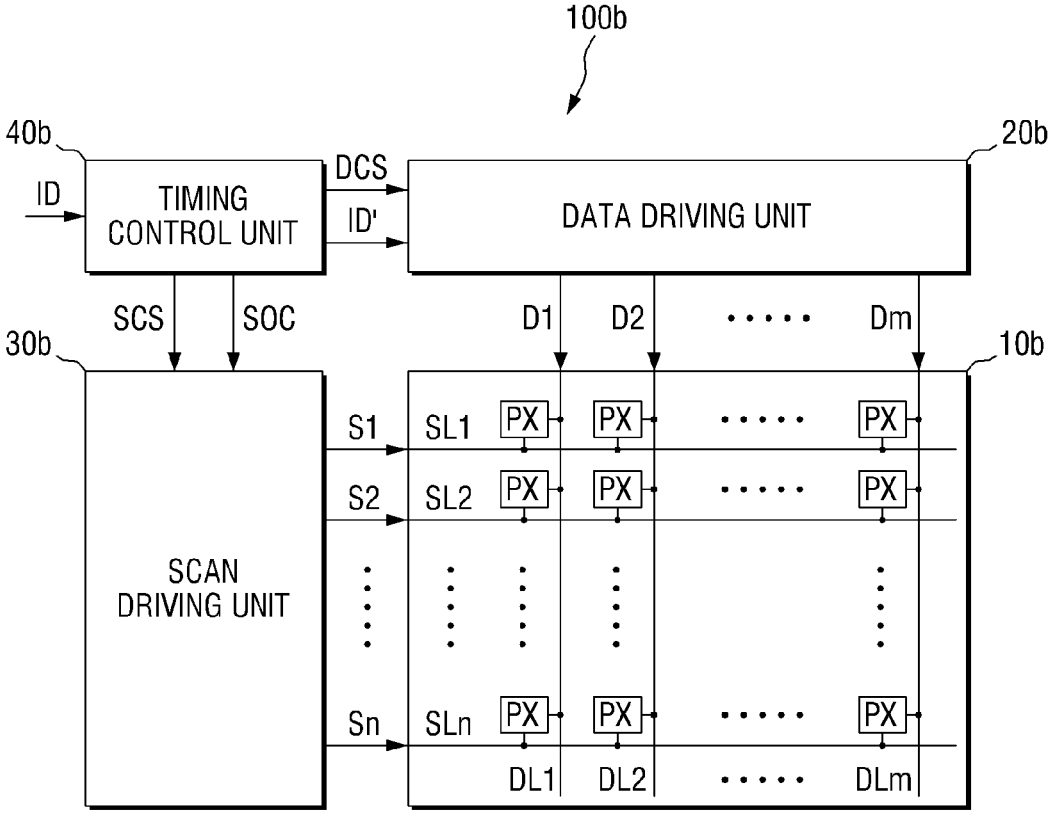
FIG. 12 is a block diagram illustrating an alternative exemplary embodiment of a display device, according to the invention.

Hereinafter, referring to FIGS. 12 and 13, another exemplary embodiment of the invention will be described. FIG. 12 is a block diagram of another alternative exemplary embodiment of a display device, according to the invention. Referring to FIG. 12, a display device 100*b* includes a display panel 10*b*, a scan driving unit 30*b*, a data driving unit 20*b* and a timing control unit 40*b*.

In such an embodiment, the display panel 10*b* includes a plurality of scan lines SL1 to SLn, a plurality of data lines DL1 to DLm which cross the plurality of scan lines SL1 to SLn, and a plurality of pixels PX which are connected to the plurality of scan lines SL1 to SLn and the plurality of data lines DL1 to DLn. In such an embodiment, each pixel PX is connected to a corresponding scan line of the plurality of scan lines SL 1 to SLn and a corresponding data line of the plurality of data lines DL1 to DLn. The plurality of scan lines SL1 to SLn may be divided into a plurality of groups as in the exemplary embodiment described above with reference to FIG. 8.

The scan driving unit 30*b* may provide the plurality of scan signals S1 to Sn, each of which includes a scan-on signal Son and a scan-off signal Soff, to the plurality of scan lines SL1 to SLn. The scan driving unit 30*b* may provide scan signals to the plurality of scan lines SL1 to SLn in accordance with the order of averages of the data voltages D1 to Dm to be transferred to the pixels connected to the scan lines SL1 to SLn that are included in the plurality of groups G1 to Gn. Such an operation of the scan driving unit 30*b* will be described in greater detail with reference to FIG. 13.

Figure 13:
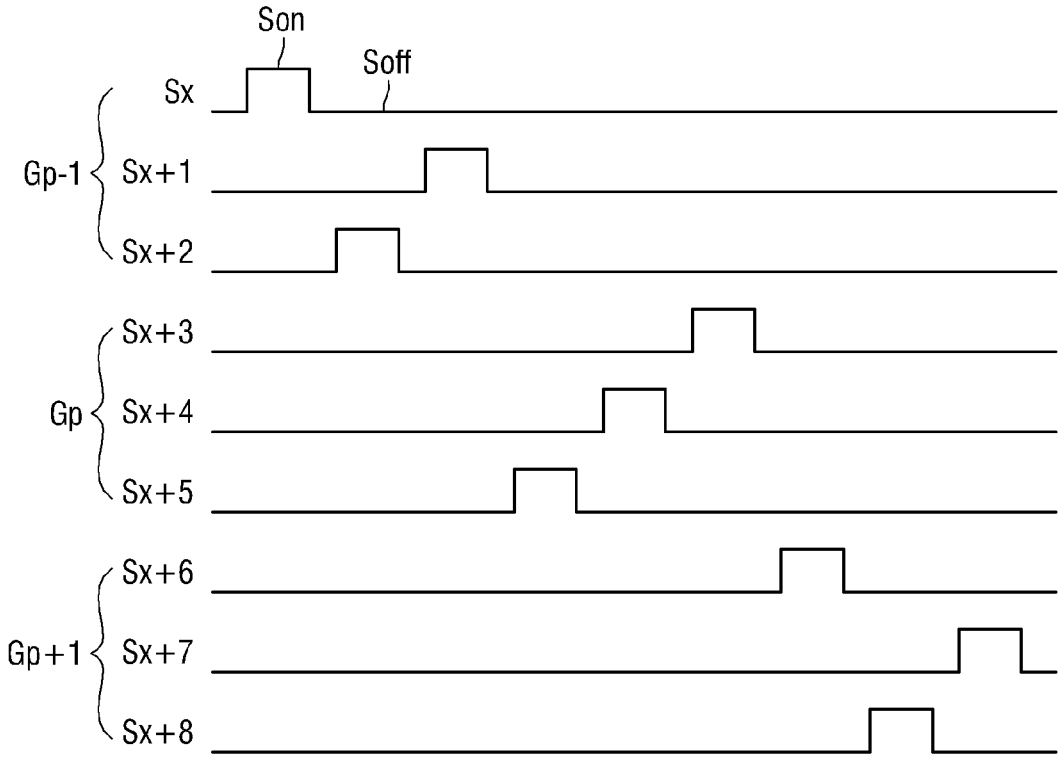
FIG. 13 is a diagram illustrating scan signals that correspond to average data voltages in an exemplary embodiment of a display device, according to the invention.

FIG. 13 is a diagram illustrating scan signals that correspond to average data voltages in an exemplary embodiment of a display device, according to the invention.

Referring to FIG. 13, in the (q−1)-th to (q+1)-th groups Gq−1, Gq, and Gq+1, the scan-on signals may be applied in a predetermined order, e.g., an ascending order, of averages of the data voltages applied to the pixels PX connected to the respective scan lines. In such an embodiment, where the display device 100*b* is driven as described above, the number of the swings in the data voltages that are applied to the pixels connected to the scan lines included in the groups may be reduced, and thus the power consumption of the display device 100*b* may be reduced.

Other features of the display device 100*b* shown in FIGS. 12 and 13 are substantially to the same as the corresponding features of the display device 100*a* of FIG. 7, and any repetitive detailed description thereof will be omitted.

Figure 14:
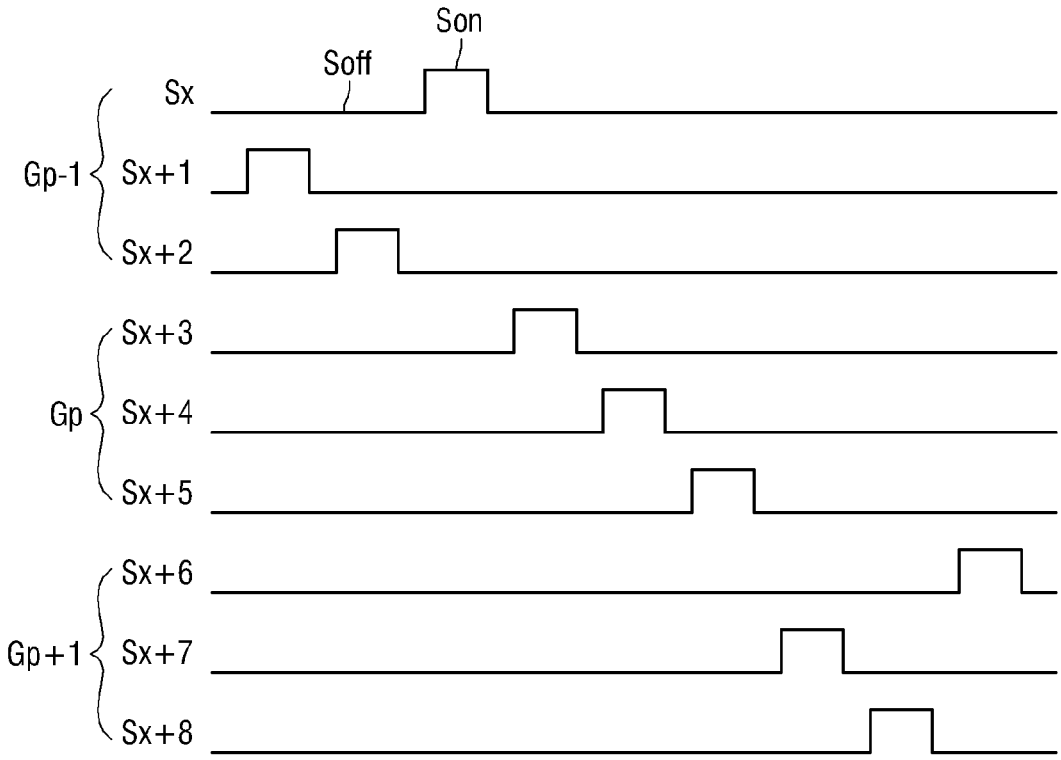
FIG. 14 is a diagram illustrating scan signals that correspond to average data voltages in an alternative exemplary embodiment of a display device, according to the invention.

Hereinafter, referring to FIG. 14, another alternative exemplary embodiment of the invention will be described. FIG. 14 is a diagram illustrating scan signals that correspond to average data voltages in another alternative exemplary embodiment of a display device, according to the invention.

The display device of FIG. 14 is substantially the same as the display device 100*b* of FIG. 12 except for an operation of the scan driving unit.

Referring to FIG. 14, in the (q−1)-th to (q+1)-th groups Gq−1, Gq, and Gq+1, the scan-on signals may be applied in a descending order of averages of the data voltages applied to the pixels PX connected to the respective scan lines. In such an embodiment, where the display device is driven as described above, the number of the swings in the data voltages that are applied to the pixels connected to the scan lines included in the groups may be reduced, and thus the power consumption of the display device may be reduced.

Figure 15:
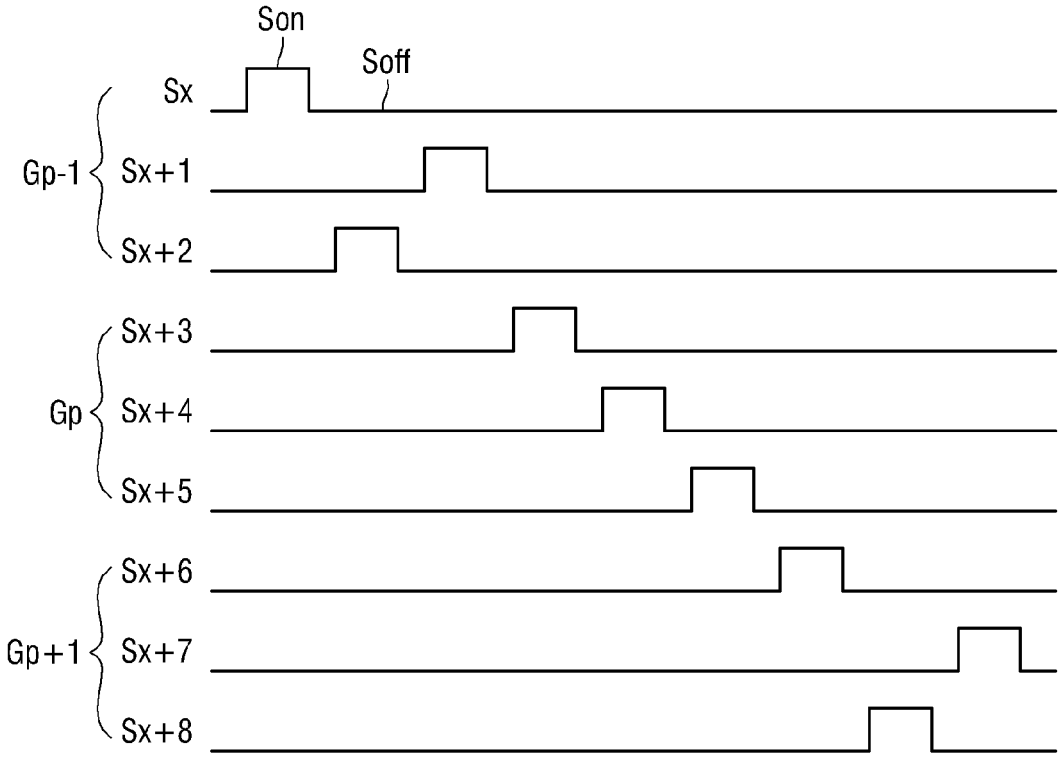
FIG. 15 is a diagram illustrating scan signals that correspond to average data voltages in another alternative exemplary embodiment of a display device, according to the invention.

Hereinafter, referring to FIG. 15, still another alternative exemplary embodiment of the invention will be described. FIG. 15 is a diagram illustrating scan signals that correspond to average data voltages in another alternative exemplary embodiment of a display device, according to the invention.

The display device of FIG. 15 is substantially the same as the display device 100*b* of FIG. 12 except for an operation of the scan driving unit.

Referring to FIG. 15, in the (q−1)-th to (q+1)-th groups Gq−1, Gq, and Gq+1, the scan-on signals may be applied in the ascending or descending order of averages of the data voltages to be applied to the pixels PX connected to the scan lines. In such an embodiment, as shown in FIG. 15, the orders of the averages of the data voltages which determine the application of the scan-on signals Son of two adjacent groups may be different from each other. In such an embodiment, where the orders of the averages of the data voltages which determines the application of the scan-on signals Son of two adjacent groups may be different from each other, the difference between the average of the data voltages transferred to the pixels PX connected to the scan lines to which the scan-on signal Son is lastly applied in a group and the average of the data voltages transferred to the pixels PX connected to a scan line to which the scan-on signal Son is firstly applied in a next group may be reduced, and thus the power consumption of the display device may be reduced.

The invention should not be construed as being limited to the exemplary embodiments set forth herein. Rather, these exemplary embodiments are provided so that this disclosure will be thorough and complete and will fully convey the concept of the present invention to those skilled in the art.

While the invention has been particularly shown and described with reference to exemplary embodiments thereof, it will be understood by those of ordinary skill in the art that various changes in form and details may be made therein without departing from the spirit or scope of the present invention as defined by the following claims.

What is claimed is:

1. A display device comprising:

a display panel comprising a plurality of scan lines, a plurality of data lines which crosses the plurality of scan lines, and a plurality of pixels which is connected to the plurality of scan lines and the plurality of data lines;

a scan driving unit which provides a plurality of scan signals, each of which comprises a scan-on signal and a scan-off signal, to the plurality of scan lines;

a data driving unit which provides a plurality of data voltages to the plurality of data lines; and a timing control unit which determines an order in which the plurality of scan signals is provided to the plurality of scan lines, wherein the scan-on signal is provided to each of the plurality of scan lines based on an order of averages of the data voltages to be transferred to the pixels connected thereto.

2. The display device of claim 1, wherein when the scan-on signal is transferred to the pixels connected to a scan line of the plurality of scan lines, the pixels connected to the scan line receive the data voltages applied to the data lines connected thereto in response to the scan-on signal.

3. The display device of claim 1, wherein the timing control unit comprises:

a scan order determination unit which receives an image data, obtains the order of the averages of the data voltages based on the image data, and determines a scan order corresponding to the order of the averages of the data voltages;

a scan driving unit control unit which generates a scan order control signal for controlling the scan driving unit to sequentially apply the scan-on signals to the plurality of scan lines in the scan order; and an image data rearrangement unit which rearranges the image data to correspond to the scan order and provides the rearranged image data to the data driving unit.

4. The display device of claim 3, wherein the scan driving unit comprises:

a scan signal generation unit which generates a plurality of original scan signals, each of which comprises the scan-on signal and the scan-off signal; and a scan signal rearrangement unit which rearranges the plurality of original scan signals based on the scan order control signal and outputs the plurality of scan signals.

5. The display device of claim 1, wherein the scan-on signal is provided to each of the plurality of scan lines based on a descending order of the averages of the data voltages.

6. The display device of claim 1, wherein the scan-on signal is provided to each of the plurality of scan lines based on an ascending order of the averages of the data voltages.

7. A display device comprising:

a display panel comprising a plurality of scan lines which are divided into a plurality of groups, a plurality of data lines which crosses the plurality of scan lines, and a plurality of pixels which is connected to the plurality of scan lines and the plurality of data lines;

a scan driving unit which provides a plurality of scan signals, each of which comprises a scan-on signal and a scan-off signal, to the plurality of scan lines;

a data driving unit which provides a plurality of data voltages to the plurality of data lines; and a timing control unit which determines an order in which the plurality of scan signals is provided to the plurality of scan lines, wherein the scan driving unit sequentially provides the plurality of scan signals to the plurality of groups, and the scan-on signal is provided to the scan lines in each of the plurality of groups based on an order of averages of the data voltages to be transferred to the pixels connected thereto.

8. The display device of claim 7, wherein the plurality of scan lines comprises first to n-th scan lines, wherein n is a natural number, the plurality of groups comprises first to p-th groups, wherein p is a natural number less than n, the first scan line is in the first group, and the scan driving unit provides the scan-on signal firstly to the first group among the first to q-th groups in a frame.

9. The display device of claim 8, wherein the scan-on signal is applied firstly to a scan line, an average of the data voltages applied to the pixels connected to which is closest to an average of the data voltages transferred lastly to the pixels connected to the scan lines in the q-th group, among the scan lines in the (q+1)-th group, wherein q is a natural number equal to or greater than 2, and equal to or less than p.

10. The display device of claim 8, wherein the scan driving unit provides the scan-on signal firstly to the first scan line in the first group in the frame.

11. The display device of claim 7, wherein the timing control unit comprises:

a scan order determination unit which receives an image data, obtains the order of the averages of the data voltages based on the image data, and determines a scan order based on the order of the averages of the data voltages;

a scan driving unit control unit which generates a scan order control signal for controlling the scan driving unit to sequentially apply the scan-on signal to each of the plurality of scan lines based on the scan order; and an image data rearrangement unit which rearranges the image data to correspond to the scan order and provides the rearranged image data to the data driving unit.

12. The display device of claim 11, wherein the scan driving unit comprises:

a scan signal generation unit which generates a plurality of original scan signals, each of which comprises the scan-on signal and the scan-off signal; and a scan signal rearrangement unit which rearranges the plurality of original scan signals based on the scan order control signal and outputs the plurality of scan signals.

13. The display device of claim 12, wherein the plurality of scan lines comprises first to n-th scan lines, the plurality of original scan signals comprises first to n-th original scan signals, the plurality of groups comprises first to p-th groups, the scan signal rearrangement unit includes first to p-th sub-units, and the q-th sub-unit receives a-th to b-th original scan signals and generates a-th to b-th scan signals through rearrangement of the a-th to b-th original scan signals, wherein n is a natural number, p is a natural number less than n, q is a natural number equal to or less than p, a is a natural number, and b is a natural number greater than a.

14. A display device comprising:

a display panel comprising a plurality of scan lines which is divided into a plurality of groups, a plurality of data lines which crosses the plurality of scan lines, and a plurality of pixels which is connected to the plurality of scan lines and the plurality of data lines;

a scan driving unit which provides a plurality of scan signals, each of which comprises a scan-on signal and a scan-off signal, to the plurality of scan lines;

a data driving unit which provides a plurality of data voltages to the plurality of data lines; and a timing control unit which determines an order in which the plurality of scan signals is provided to the plurality of scan lines, wherein the scan driving unit sequentially provides the plurality of scan signals to the plurality of groups, and the scan-on signal is provided to the scan lines in each of the plurality of groups in an order, which is determined based on an order of averages of the data voltages to be transferred to the pixels connected thereto, wherein the order of the averages of the data voltage is an ascending order or a descending order.

15. The display device of claim 14, wherein the plurality of scan lines comprises first to n-th scan lines, the plurality of groups comprises first to p-th groups, the first scan line is in the first group, the scan driving unit provides the scan-on signal firstly to the first group among the first to q-th groups in one frame, n is a natural number equal to or greater than 2, and p is a natural number less than n.

16. The display device of claim 15, wherein the scan driving unit provides the scan-on signal to each of the scan lines in the q-th group based on the ascending order of the averages of the data voltages transferred to the pixels connected to the scan lines in the q-th group, the scan driving unit provides the scan-on signal to each of the scan lines in the (q+1)-th group based on the descending order of the averages of the data voltages transferred to the pixels connected to the scan lines in the (q+1)-th group, and q is a natural number equal to or less than p−1.

17. The display device of claim 15, wherein the scan driving unit provides the scan-on signals to each of the scan lines in the q-th group based on the descending order of the averages of the data voltages transferred to the pixels connected to the each of the scan lines in the q-th group, the scan driving unit provides the scan-on signal to each of the scan lines in the (q+1)-th group based on the ascending order of the averages of the data voltages transferred to the pixels connected to the each of the scan lines in the (q+1)-th group, and q is a natural number equal to or less than p−1.

18. The display device of claim 14, wherein the timing control unit comprises:

a scan order determination unit which receives an image data, obtains the order of the averages of the data voltages based on the image data, and determines a scan order based on the order of the averages of the data voltages;

a scan driving unit control unit which generates a scan order control signal for controlling the scan driving unit to sequentially apply the plurality of scan-on signals to the plurality of scan lines to correspond to the scan order; and an image data rearrangement unit which rearranges the image data to correspond to the scan order and provides the rearranged image data to the data driving unit.

19. The display device of claim 18, wherein the scan driving unit comprises:

a scan signal generation unit which generates a plurality of original scan signals, each of which comprises the scan-on signal and the scan-off signal; and a scan signal rearrangement unit which rearranges the plurality of original scan signals based on the scan order control signal and outputs the plurality of scan signals, wherein the plurality of scan lines comprises first to n-th scan lines, the plurality of original scan signals comprises first to n-th original scan signals, the plurality of groups comprises first to p-th groups, the scan signal rearrangement unit comprises first to p-th sub-units, the q-th sub-unit receives a-th to b-th original scan signals and generates a-th to b-th scan signals through rearrangement of the a-th to b-th original scan signals, and n is a natural number, p is a natural less than n, q is a natural equal to or less than p, a is a natural number, and b is a natural number greater than a.

* * * * *